US008210549B1

(12) United States Patent
Swenson

(10) Patent No.: US 8,210,549 B1
(45) Date of Patent: Jul. 3, 2012

(54) SKATEBOARD WHEEL TRUCK ASSEMBLY

(76) Inventor: Eric L. Swenson, San Francisco, CA (US)

( * ) Notice: Subject to any disclaimer, the term of this patent is extended or adjusted under 35 U.S.C. 154(b) by 481 days.

(21) Appl. No.: 12/454,125

(22) Filed: May 12, 2009

(51) Int. Cl.
*B62M 1/00* (2010.01)
*A63C 17/02* (2006.01)

(52) U.S. Cl. ..... 280/87.042; 280/11.28

(58) Field of Classification Search ..... 280/7.13, 280/809, 841, 11.209, 11.27, 11.28, 11.19, 280/87.041, 87.042
See application file for complete search history.

(56) References Cited

U.S. PATENT DOCUMENTS

| | | | | | |
|---|---|---|---|---|---|
| 2,560,017 | A * | 7/1951 | Ware | 280/11.28 |
| 2,578,911 | A * | 12/1951 | Van Horn | 280/11.28 |
| 2,595,751 | A * | 5/1952 | Balstad | 280/11.28 |
| 2,719,725 | A * | 10/1955 | Ware | 280/11.28 |
| 3,377,079 | A * | 4/1968 | Barczak | 280/11.28 |
| 4,047,725 | A * | 9/1977 | Pinchock | 280/11.28 |
| 4,298,209 | A * | 11/1981 | Peters | 280/11.209 |
| 6,105,978 | A | 8/2000 | Vuerchoz | |
| 6,182,987 | B1 * | 2/2001 | Bryant | 280/87.042 |
| 6,315,304 | B1 * | 11/2001 | Kirkland et al. | 280/11.28 |
| 6,315,312 | B1 * | 11/2001 | Reyes et al. | 280/87.042 |
| 6,367,819 | B1 | 4/2002 | Andersen et al. | |
| 6,443,471 | B1 * | 9/2002 | Mullen | 280/87.042 |
| 6,467,782 | B1 * | 10/2002 | Smith | 280/87.042 |
| 6,523,837 | B2 * | 2/2003 | Kirkland | 280/11.28 |
| 6,739,603 | B1 | 5/2004 | Powell | |
| 6,793,224 | B2 * | 9/2004 | Stratton | 280/87.042 |
| 7,044,485 | B2 | 5/2006 | Kent et al. | |
| 2007/0164530 | A1 * | 7/2007 | Horn | 280/87.042 |
| 2009/0256325 | A1 * | 10/2009 | Dickie | 280/87.042 |

* cited by examiner

*Primary Examiner* — J. Allen Shriver, II
*Assistant Examiner* — Bridget Avery
(74) *Attorney, Agent, or Firm* — Thomas M. Freiburger

(57) ABSTRACT

A skateboard wheel truck assembly has a suspension including a non-circular base bushing with wings or arms extending laterally outwardly, providing for increased stability and control and reduction of wobble in use of the skateboard.

17 Claims, 3 Drawing Sheets

FIG. 1
PRIOR ART
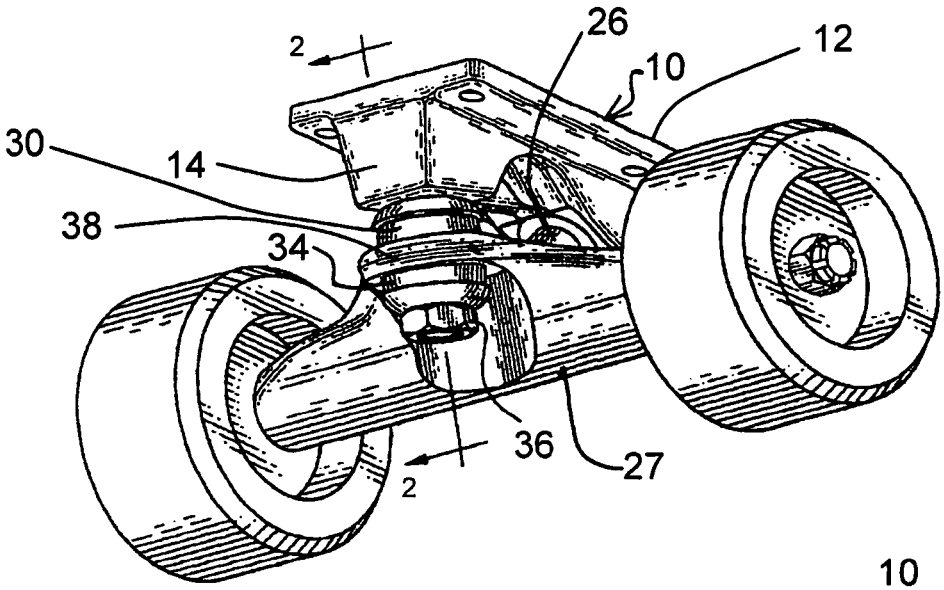
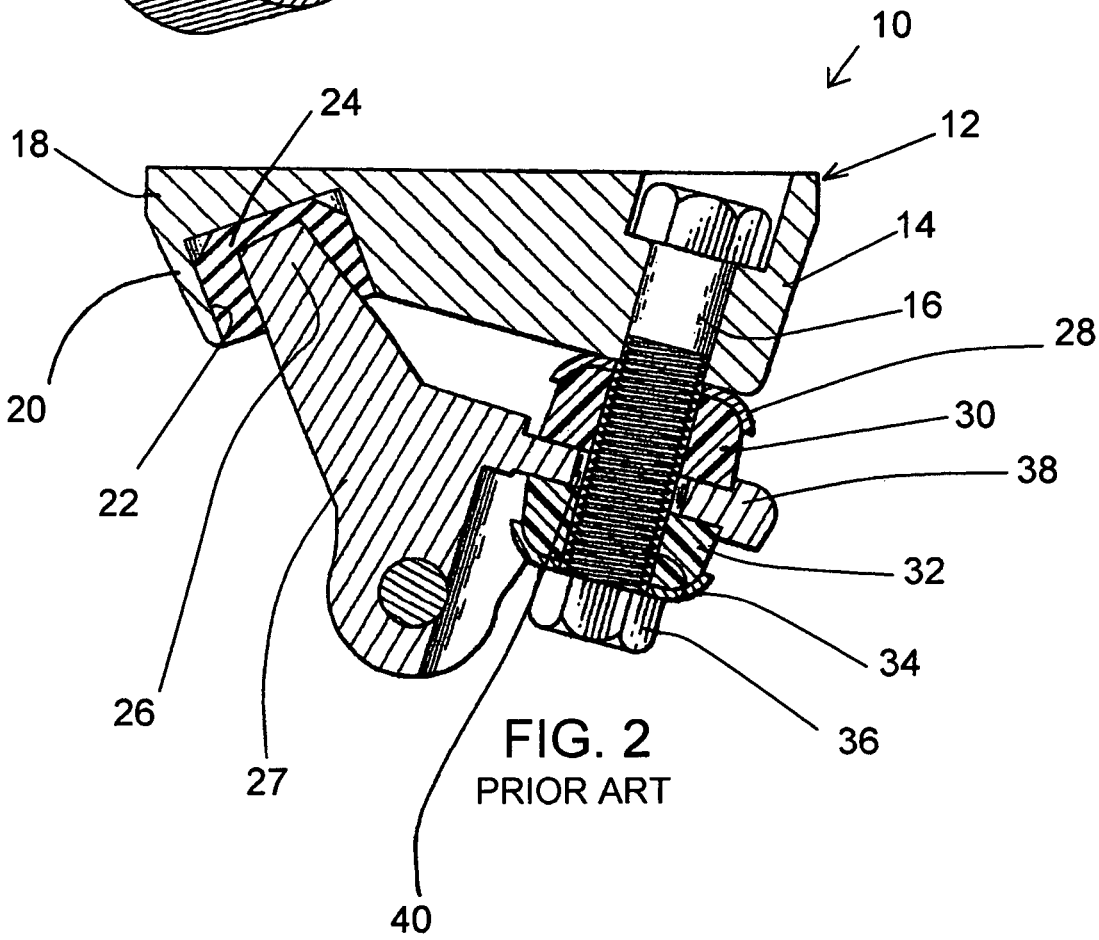
FIG. 2
PRIOR ART

SKATEBOARD WHEEL TRUCK ASSEMBLY

BACKGROUND OF THE INVENTION

This invention concerns skateboards, and especially wheel trucks supported beneath the skateboards on elastomeric bushings.

Skateboards have developed and evolved over the years. A relatively crude form of skateboard was available in the 1960s but did not achieve very wide use. The development of better wheel trucks and wheels, especially polyurethane wheels, brought skateboards much greater popularity, and in fact the development of these skateboard wheels led to better wheels on roller skates. The design of the skateboards, wheel trucks and suspension systems was continually improved, producing better steerability, agility and control in use of skateboards.

Elastomeric shock absorbing bushings have improved suspension, and also provided steerability. This type of mounting, shown in U.S. Pat. Nos. 6,105,978 and 6,739,603, has a base plate fixed to the bottom of the skateboard, with a threaded post extending down at an angle from the base plate. A wheel truck is secured to the threaded post in a sandwiched connection between two elastomeric bushings, one above and one below an opening in the wheel truck, tightened down by a nut on the threaded bolt or stud. A pivot point for steering is established by a pivot post that extends usually integrally from the wheel truck body into an elastomerically-lined bore or socket in the base plate, positioned about 1½" or so from the threaded stud. Tipping of the skateboard platform, by shifting the weight of the user, rocks the wheel truck relative to the skateboard and causes a small turn angle of the wheel truck to occur relative to the skateboard platform, by swinging the wheel truck about the steering pivot point. Adjustments in stiffness can be made by tightening or loosening the nut on the threaded bolt or stud, or using elastomeric materials of different hardnesses.

U.S. Pat. No. 7,044,485 shows a modified form of the above-described wheel truck suspension, utilizing three discrete elastomeric bushing support points, one with a threaded post secured to a base plate as just described, and additional bushing seats at left and right, in a non-linear positional relation with the threaded bolt, upon which the metal wheel truck body rests. The outboard elastomeric supports are characterized as shock absorbers that can be interchanged for different response.

SUMMARY OF THE INVENTION

The current invention improves over prior skateboard wheel truck suspension designs by providing a better elastomeric suspension system that can use an essentially standard style base plate while achieving improved stability, control and reduction of wobble through the design of the wheel truck and the base elastomeric bushing that resides on a threaded post between the wheel truck and the fixed base plate. In one sense the invention can be said to achieve the benefits of the outboard bushing suspension shown in U.S. Pat. No. 7,044,485 discussed above, without the larger and more complex bracket and wheel truck assembly shown in that patent. This is a simpler and more efficient design for accomplishing improved stability and control.

In a preferred embodiment the base bushing, of elastomeric material such as polyurethane, is shaped not as a cylinder or slightly conical as in previous designs, but with a pair or wings or arms which extend outwardly and forwardly relative to the skateboard (referring to the front wheel truck). These arms act somewhat as flexible buttresses. The truck-engaging surface of this base bushing with its wings approximates a triangle but with the rear side of this surface preferably rounded, although it could be otherwise shaped. This surface engages in a similarly shaped recess in the upper side of the wheel truck body, toward the rear, with the threaded stud or bolt from the base plate extending up through the recess. The upper surface of this base bushing could be flat, or it could be convex or concave to match with a complementarily-shaped washer surface for a stable seat with the washer. The footprint shape of this top side of the base bushing can be round, or other shapes such as similar to the lower, truck-engaging side, but preferably with a narrower width at the middle of the bushing, or a generally hourglass shape to the bushing to allow greater deflection of the buttress arms. Even an hourglass shape round at both ends can be effective; it is important that the bushing not be a solid cylinder (or partially tapered cylinder) of enlarged diameter, because this will cause an undesired degree of increasing resistance to bending as one goes deeper into a turn.

Another bushing, which can be round or otherwise shaped (optionally shaped similarly to the base bushing) is secured at the outer end of the threaded stud or post. This assembly of a portion of the truck body sandwiched between two elastomeric bushings is compressed together by tightening a nut.

As the wheel truck rocks left or right relative to the fixed base plate or bracket, the arms or wings of the base elastomeric bushing compress, deflect and bend on the compression side, i.e. the direction of turning, but the opposite arm migrates out of the truck body recess. The surfaces of the arms, and the configuration of the truck body recess, are shaped to establish smooth return of the bushing back into the recess when the turn is complete.

It is among the objects of the invention to improve stability and control of a skateboard, with smooth transition through turns and less wobble, in a compact and efficient wheel truck assembly. These and other objects, advantages and features of the invention will be apparent from the following description of a preferred embodiment, considered along with the accompanying drawings.

DESCRIPTION OF THE DRAWINGS

FIG. 1 is a perspective view showing a typical prior art skateboard wheel truck assembly.

FIG. 2 is a sectional elevation view showing the prior art wheel truck assembly.

DESCRIPTION OF PREFERRED EMBODIMENTS

Figure 3:
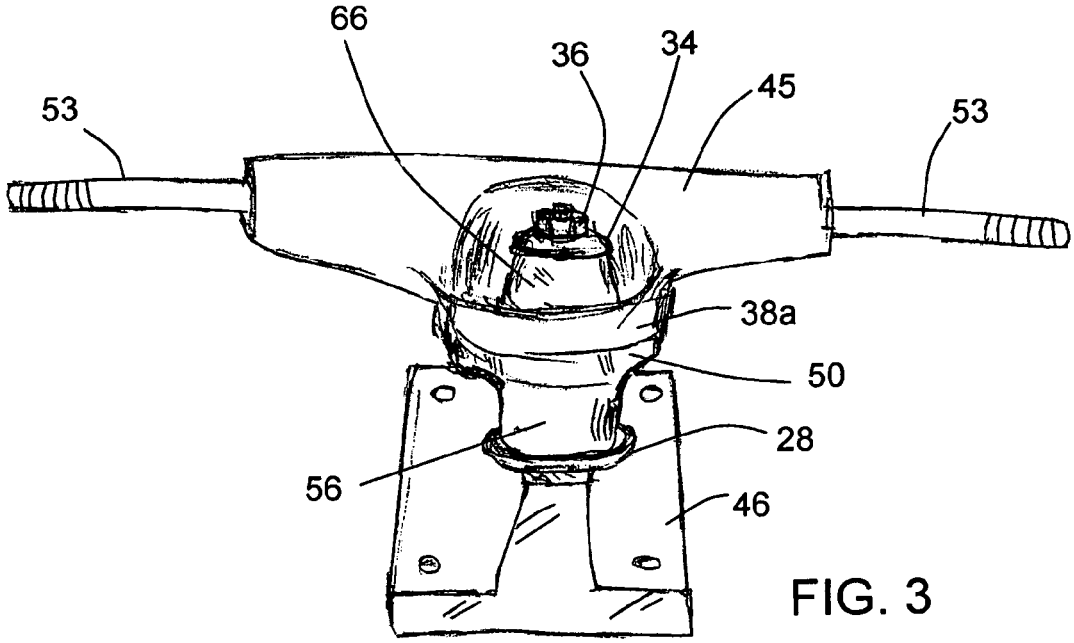
FIG. 3 is a perspective view showing a skateboard wheel truck assembly of the invention.

In the drawings, FIGS. 1 and 2 show a typical prior art arrangement for the front wheel truck of a skateboard. The wheel truck assembly 10 includes a base plate or base bracket 12, to be attached by fasteners up against the bottom surface of the skateboard, which is not shown. FIG. 1 can be considered to show a front wheel truck assembly viewed from the rear. The base plate 12 for the front wheel truck has a rear platform or pedestal 14 which supports a threaded stud or bolt 16, extending downward and angled slightly forwardly as shown particularly in FIG. 2 (the near end of the skateboard is to the left in FIG. 2). At the front end 18 of the base plate is a raised portion or boss 20 having a recess 22 with a rubbery insert member 24, i.e. an elastomeric grommet that lines the recess. Within this grommet 24 is received a pivot post 26 that is part of the wheel truck base plate 12 and a portion of which can be seen at 26 in FIG. 1. The threaded stud or bolt 16 supports and secures a wheel truck body 27 in a flexible, cushioned manner. Assembled onto the threaded bolt 16 is a first cup shaped washer 28, a base bushing 30, an outer bushing 32, and a second cup shaped washer 34, with the assembly retained by a nut 36. The two bushings sandwich a rearward flange 38 of the wheel truck body between them, as shown in both FIGS. 1 and 2. As is well known in the operation of this type of skateboard wheel truck suspension, when the user leans the skateboard to one side, the wheel truck pivots in a rocking sort of motion relative to the base plate 12 and the skateboard. This pivoting is generally about the tip of the pivot post 26. The rearward flange 38 of the wheel truck sways to left or right, which it is permitted to do by a hole 40 in this rearward flange 38, the hole being larger than the threaded bolt 16. Thus, shifting the weight and tipping the skateboard to the left, for example, will cause the skateboard to rock to the left, tipping relative to the wheel truck, swinging the angle of the bolt 16 in the flange hole 40, and changing the angle of the wheel truck with the skateboard by a degree or two or more. Thus, the skateboard turns to the left.

The invention, as explained above, improves the steerability and control of a skateboard and eliminates or reduces wobble, adding to stability and safety of the skateboard, through an improved suspension connecting the wheel truck to the skateboard. FIG. 3 shows a wheel truck 45 of the invention, without wheels, secured to a base plate 46 that is to be secured by fasteners to the bottom side of a skateboard, not shown. The wheel truck 45 and base plate 46 are shown inverted in this view.

Figure 4:
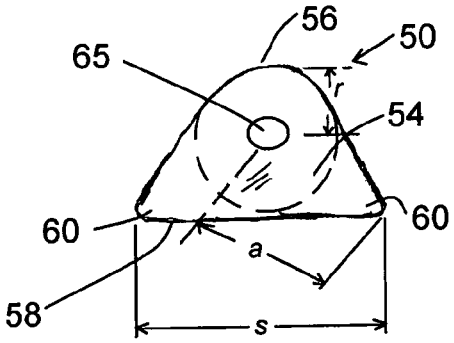
FIG. 4 is a view showing a base bushing in a configuration pursuant to the invention.
Figure 5:
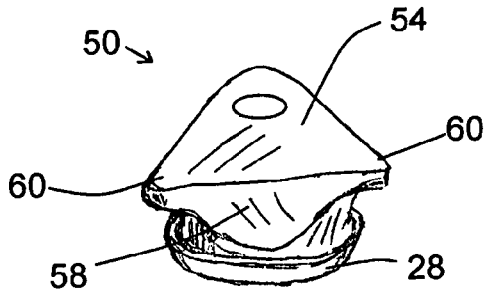
FIG. 5 is another view showing the base bushing and a washer.
Figure 6:
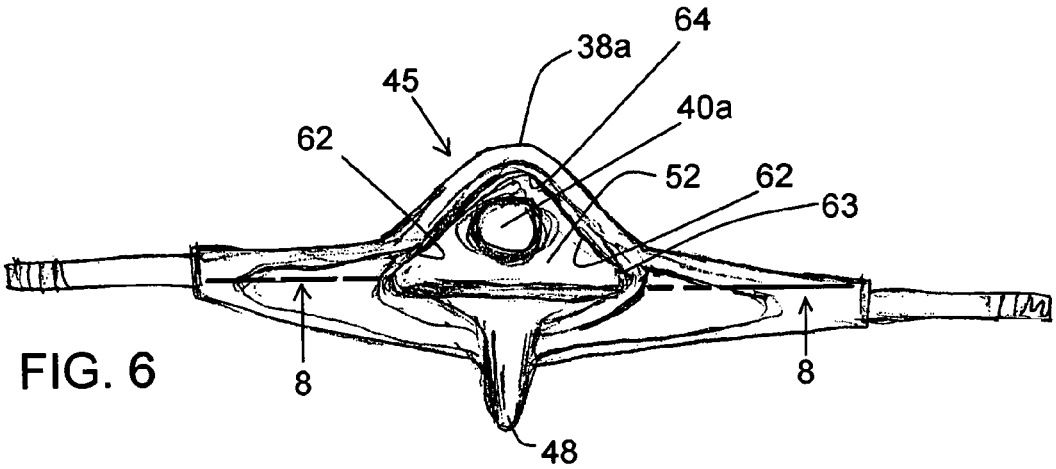
FIG. 6 is a bottom view of a wheel truck body of the invention.

The base plate 46 can be the same as the base plate 12 shown in the prior art views just described. The base plate has a recess with a grommet for receiving a pivot post 48 (FIG. 6) of the wheel truck body, although the pivot recess is not seen in these drawing views. The suspension for the wheel truck 45 utilizes a modified base bushing 50, and the wheel truck's upward surface, seen in FIG. 6, is modified to receive this base bushing. FIG. 6 shows a generally triangular recess 52 in the upper surface of the wheel truck body. This is shaped as a seat to receive the generally flat surface 54 of the base bushing (although that surface 54 could be somewhat rounded). The lower surface of the base bushing is shown in FIG. 4, and the bushing 54 is shown positioned in the upper cup-shaped washer 30 in the perspective view of FIG. 5. FIG. 3 shows the preferably rounded (e.g. generally cylindrical) rear surface 56 of the base bushing, while FIG. 5 shows the forward side 58, assuming the truck assembly is at the front of a skateboard (typically the rear truck is the same, oppositely directed). The wheel axle is shown at 53.

Figure 8:
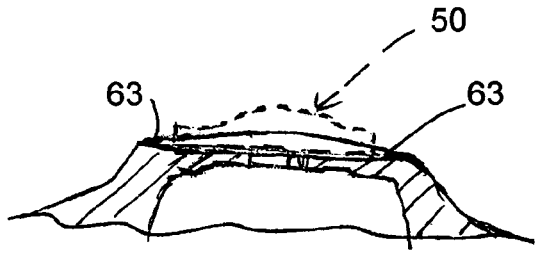
FIG. 8 is a sectional view generally as seen along the plane 8-8 in FIG. 7, and showing a part of the wheel truck body and the manner in which the base bushing seats against a recess on the wheel truck body.

As shown in the drawings, the generally triangular shaped lower surface 54 of the base bushing of the invention provides a pair of buttress-like wings or arms 60 at each of left and right sides. The truck body recess 52 is shaped to receive this surface, and in fact the recess 52 has sloped or ramp-like edges 62 on the left and right sides of the triangle, for a smoother transition of the arms 60 into and out of the recess as the wheel truck sways or rocks during turns. This provides for a smooth transitioning into and out of a turn, avoiding a snagging of an arm as it is displaced or as it re-enters the recess after being displaced in a turn. In fact, at left and right corner regions 63 there is preferably no ledge at all but can be a slight incline, as shown particularly in FIG. 8. In that sectional view a ledge 64 is seen beyond the viewing plane, but at and near the corners 63 this ledge tapers down to a flat or a slight incline. The neutral position of the base bushing 50 is generally and schematically illustrated in dashed lines.

As an example of a preferred embodiment, the base bushing 50 may have a base diameter of about 24 mm to 25 mm, i.e. a radius as shown at r in FIG. 4 of about 12 mm. The upper side of this bushing preferably (but not necessarily) is generally circular as shown in dashed lines in FIG. 4, and as shown in FIG. 5 where that end is engaging in the cup shaped washer 28 (other shapes can be used for the upper side of this bushing, as described above). A bolt hole 65 is preferably at the circular center. The arms, however, extend considerably beyond this base radius r, and may have an arm length a from the radius center, for example, of about 24 mm, 12 mm beyond the normal radius. The total span s across the two arms 60, i.e. the length of the rear side 58 where it meets the generally flat surface 54, may be about 40 mm to 42 mm, or greater if desired. It is this width, the approximately 40 to 42 mm width represented by the span of the arms, that provides for the increased stability and control in the skateboard suspension, and this width preferably is at least about 40 mm. This compares to a width on a round base bushing of about 24 to 25 mm as typical in prior art suspensions, typically on a truck body about 12.8 cm (5 inches) wide excluding the axle protrusions, and it compares to a front to back depth (at a maximum point) of the bushing 50 of about 26 mm. Note that the dimensions of the bushing 50 of the invention can vary. The span of the arms could be longer or slightly shorter, or the overall size of the base bushing could be different, but with the bottom side width or arm span still wide in relationship to the base diameter of the bushing as referred to above, or in comparison to the depth of the bushing (front to back), or as a minimum ratio of width as compared to truck body width (wheel span). For example, in a preferred embodiment the arm length a may be at least about twice the radius r, or at least about 1.6 times the radius. The arm span across the two arms 60 (the width of the bottom side), is substantially larger than the base end width or the depth of the bushing. For example, it may be at least about 1.75 times the diameter at the upper end of the base bushing or 1.75 times the maximum depth of the bushing, or at least about 1.5 times the diameter or 1.5 times the maximum depth. As compared to the truck body width (axle excluded), the width s is preferably at least about one-third the truck body width, or at least about 5/16 the truck body width, as compared to a typical bushing face about 3/16 the truck body width. Note that although the general shape of the base bushing shown in FIGS. 3 through 7 is preferred, other shapes for the lower end, i.e. the surface 54, can be used. Instead of a generally triangular shape as shown, the surface 54 could be something like an ellipse, with the two arm ends in line with the center bolt hole 65. The arm ends can be more pointed than those of an ellipse. The reason a generally triangular shape is preferred, with the arms 60 offset from the bolt hole 65, is that the wheel truck body 45 can be more compact, as can be seen from FIGS. 6 and 7, with a generally triangular shape in which the buttress-like arms and the corresponding arm positions in the recess 52 on the truck body are generally in line with the main structure of the wheel truck body. The arms could be moved outwardly (up the page in FIG. 6), but this would require additional truck body structure.

As shown in FIG. 3, the suspension assembly includes a second or lower bushing 66, another washer 34, and a nut 36 to tighten the assembly as desired, with the truck body flange 38*a* sandwiched between the two bushings. FIG. 6 shows the hole 40*a* through the truck body flange 38*a*, within the recess area or bushing seat 52. The hole is substantially larger than the bolt, e.g. about 4-5 mm larger in diameter, to allow for the swaying motion of the wheel truck in turning.

Figure 7:
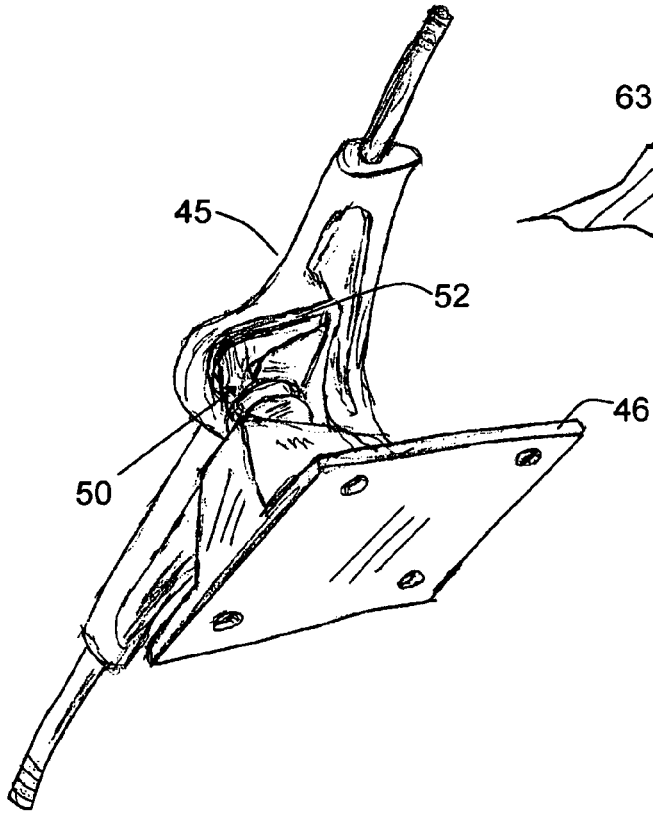
FIG. 7 is a perspective view of the base plate and wheel truck body and showing the base bushing of the invention.

FIG. 7 shows the base bushing 50 of the invention as seated in the generally triangular recess or bushing seat 52 of the wheel truck body 45.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A wheel truck assembly for a skateboard, comprising:

a base plate adapted for attachment to the underside of a skateboard deck, the base plate including a bolt extending generally downwardly from one end, and having a recess lined with elastomeric material at an opposite end, a wheel truck body secured to the base plate, the wheel truck body having an axle for supporting two wheels and having a pivot post extending into the elastomeric-lined recess of the base plate, and the wheel truck body further including a flange extending in the direction of the one end of the base plate, the flange having a hole of larger diameter than the bolt and positioned with the bolt extending through the hole, a pair of suspension bushings positioned on the bolt, on opposed sides of the flange, including a base bushing adjacent to the base plate and an outer bushing remote from the base plate, both bushings engaging the flange firmly between them and, with the pivot post, providing for turning of the wheel truck relative to the skateboard deck, and the base bushing being non-round and having, at a lower side engaging against the wheel truck body, a pair of laterally outwardly extending arms defining a span between arms, said span being substantially greater than a depth dimension of the base bushing, the arms acting as flexible buttresses for providing greater support, control and stability for the wheel truck on the skateboard, particularly during turns.

2. The wheel truck assembly of claim 1, wherein the lower side of the base bushing is generally triangular in shape.

3. The wheel truck assembly of claim 1, wherein the base bushing is generally round at an upper end, with a cup-shaped washer engaging the upper end of the bushing, and the upper end generally having a diameter, and the span of said arms being at least about 1.5 times the diameter of the upper end.

4. The wheel truck assembly of claim 1, wherein the base bushing has a maximum depth from front to back, and the span of said arms being at least about 1.5 times the depth.

5. The wheel truck assembly of claim 1, wherein the base bushing has a maximum depth from front to back, and the span of said arms being at least 1.75 times the depth.

6. The wheel truck assembly of claim 1, including cup-shaped washers engaging the upper end of the base bushing and the lower end of the outer bushing.

7. The wheel truck assembly of claim 1, wherein the wheel truck body has a recess on an upper side, positioned essentially on the flange, the recess being generally matched to the shape of the lower side of the base bushing.

8. The wheel truck assembly of claim 1, wherein the base bushing comprises essentially a central body mass around the base plate bolt and integral arms extending laterally outwardly and defining said span between arms at least 1.5 times the width of the central body mass of the base bushing.

9. The wheel truck assembly of claim 1, wherein the base bushing comprises essentially a central body mass around the base plate bolt and integral arms extending laterally outwardly and defining said span between arms at least 1.75 times the width of the central body mass of the base bushing.

10. The wheel truck assembly of claim 3, wherein the span of the arms is at least 1.75 times said diameter.

11. The wheel truck assembly of claim 7, wherein the wheel truck body is shaped such that as the recess of the truck body slides relative to the base bushing during a turn, the arms of the base bushing slide over a smooth surface of the truck body free of confining edges.

12. A wheel truck assembly for a skateboard, comprising:

a base plate adapted for attachment to the underside of a skateboard deck, the base plate including a bolt extending generally downwardly from one end, and having a recess lined with elastomeric material at an opposite end, a wheel truck body secured to the base plate, the wheel truck body having a width and having an axle for supporting two wheels, and further having a pivot post extending into the elastomeric-lined recess of the base plate, and the wheel truck body further including a flange extending in the direction of the one end of the base plate, the flange having a hole of larger diameter than the bolt and positioned with the bolt extending through the hole, a pair of suspension bushings positioned on the bolt, on opposed sides of the flange, including a base bushing adjacent to the base plate and an outer bushing remote from the base plate, both bushings engaging the flange firmly between them and, with the pivot post, providing for turning of the wheel truck relative to the skateboard deck, and the base bushing being non-round and having, at a lower side engaging against the wheel truck body, a pair of laterally outwardly extending arms defining a span between arms, said span being at least 40 mm, the arms acting as flexible buttresses for providing greater support, control and stability for the wheel truck on the skateboard, particularly during turns.

13. The wheel truck assembly of claim 12, wherein the lower side of the base bushing is generally triangular in shape.

14. The wheel truck assembly of claim 12, wherein the base bushing is generally round at an upper end, with a cup-shaped washer engaging the upper end of the bushing, and the upper end generally having a diameter, and the span of said arms being at least 1.5 times the diameter of the upper end.

15. The wheel truck assembly of claim 12, wherein the span between arms is at least one-third the width of the wheel truck body.

16. The wheel truck assembly of claim 12, wherein the span between the arms is at least about 5/16 the width of the wheel truck body.

17. A wheel truck assembly for a skateboard, comprising:

a base plate adapted for attachment to the underside of a skateboard deck, the base plate including a bolt extending generally downwardly from one end, and having a recess lined with elastomeric material at an opposite end, a wheel truck body secured to the base plate, the wheel truck body having a width and having an axle for supporting two wheels, and further having a pivot post extending into the elastomeric-lined recess of the base plate, and the wheel truck body further including a flange extending in the direction of the one end of the base plate, the flange having a hole of larger diameter than the bolt and positioned with the bolt extending through the hole, a pair of suspension bushings positioned on the bolt, on opposed sides of the flange, including a base bushing adjacent to the base plate and an outer bushing remote from the base plate, both bushings engaging the flange firmly between them and, with the pivot post, providing for turning of the wheel truck relative to the skateboard deck, and the base bushing having, at a lower side engaging against the wheel truck body, a maximum width which is at least about 5/16 the width of the wheel truck body, thus providing greater support, control and stability for the wheel truck on the skateboard, particularly during turns, the base bushing being non-round at the lower side, defining a pair of laterally outwardly extending arms extending wider than an upper side of the base bushing.

* * * * *